US011585177B2

(12) United States Patent
Al-Mousa et al.

(10) Patent No.: US 11,585,177 B2
(45) Date of Patent: Feb. 21, 2023

(54) REMOVING A TUBULAR FROM A WELLBORE

(71) Applicant: Saudi Arabian Oil Company, Dhahran (SA)

(72) Inventors: Ahmed Al-Mousa, Dhahran (SA); Bandar S. Al-Malki, Dammam (SA); Mohammed Ahmed Alkhowaildi, Safwa (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 40 days.

(21) Appl. No.: 17/237,822

(22) Filed: Apr. 22, 2021

(65) Prior Publication Data

US 2022/0341273 A1 Oct. 27, 2022

(51) Int. Cl.

| | |
|---|---|
| ***E21B 29/00*** | (2006.01) |
| ***E21B 31/16*** | (2006.01) |
| ***E21B 31/00*** | (2006.01) |
| ***E21B 33/04*** | (2006.01) |
| ***E21B 31/20*** | (2006.01) |
| ***E21B 31/107*** | (2006.01) |

(52) U.S. Cl.

CPC ..... *E21B 29/005* (2013.01); *E21B 31/005* (2013.01); *E21B 31/107* (2013.01); *E21B 31/16* (2013.01); *E21B 31/20* (2013.01); *E21B 33/0422* (2013.01)

(58) Field of Classification Search

CPC ..... E21B 31/16; E21B 29/005; E21B 31/005; E21B 31/107; E21B 31/20; E21B 33/0422

See application file for complete search history.

(56) References Cited

U.S. PATENT DOCUMENTS

| | | | | |
|---|---|---|---|---|
| 5,101,895 | A * | 4/1992 | Gilbert | E21B 23/006 294/86.34 |
| 7,090,019 | B2 | 8/2006 | Barrow et al. | |
| 7,370,703 | B2 * | 5/2008 | Hill | E21B 29/005 82/82 |
| 7,762,330 | B2 | 7/2010 | Saylor, III et al. | |
| 8,662,182 | B2 | 3/2014 | Redlinger et al. | |
| 9,353,589 | B2 | 5/2016 | Hekelaar | |

(Continued)

FOREIGN PATENT DOCUMENTS

| | | | |
|---|---|---|---|
| GB | 2396634 | 6/2004 | |
| WO | WO-2019164404 A1 * | 8/2019 | E21B 31/005 |

*Primary Examiner* — Nicole Coy

(74) *Attorney, Agent, or Firm* — Fish & Richardson P.C.

(57) ABSTRACT

Techniques for removing a tubular from a wellbore include running a downhole tool on a downhole conveyance into a wellbore formed from a terranean surface into a subterranean formation; activating a piston sub-assembly to repeatedly move pistons to contact a portion of a casing installed in the wellbore to at least de-bond a cement layer installed between the portion of the casing and the subterranean formation from the portion of the casing; activating a cutting sub-assembly to move a cutting blade to cut through the portion of the casing adjacent the de-bonded portion of the cement layer; activating a hanger sub-assembly to move a set of slips into contacting engagement with the cut portion of the casing; and running the downhole tool on the downhole conveyance out of the wellbore with the cut portion of the casing engaged with the set of slips.

25 Claims, 10 Drawing Sheets

(56) References Cited

U.S. PATENT DOCUMENTS

| | | | | |
|---|---|---|---|---|
| 10,544,640 | B2 | 1/2020 | Hekelaar et al. | |
| 10,711,552 | B2 * | 7/2020 | Wilson | E21B 34/10 |
| 10,883,359 | B2 * | 1/2021 | Stokes | E21B 33/134 |
| 11,225,849 | B2 * | 1/2022 | McGarian | E21B 33/12 |
| 2020/0224509 | A1 * | 7/2020 | Telfer | E21B 31/16 |
| 2020/0325746 | A1 * | 10/2020 | Lerbrekk | E21B 33/13 |

* cited by examiner

REMOVING A TUBULAR FROM A WELLBORE

TECHNICAL FIELD

The present disclosure describes apparatus, systems, and methods for removing a tubular from a wellbore such as removing at least a portion of a casing from a wellbore.

BACKGROUND

Hydrocarbon production wells, and other wells formed to extract other fluids from a subterranean reservoir, often include one or more tubulars installed within a wellbore during construction of the well. Such tubulars can include one or more casings. In some instances, ne laterals or sidetracks are desired to be formed from a vertical portion of the wellbore. In certain well designs, there is no further room to drill sidetracks, while some wells have aged and corrosive casings that may not withstand a milling load for a new window to form the new lateral or sidetrack. Some other wells do not have good cement behind the casings, which might cause further complications.

SUMMARY

In an example implementation, a downhole tool includes a top sub-assembly configured to couple to a downhole conveyance that is operable to run the downhole tool into a wellbore formed from a terranean surface into a subterranean formation; a piston sub-assembly coupled with the top sub-assembly and including a plurality of pistons configured to moveably contact a portion of a casing installed in the wellbore to at least de-bond a portion of a cement layer installed between the portion of the casing and the subterranean formation from the portion of the casing; a cutting sub-assembly coupled with the top sub-assembly and the piston sub-assembly and including at least one cutting blade configured to moveably cut through the portion of the casing adjacent the de-bonded portion of the cement layer; and a hanger sub-assembly coupled with the top sub-assembly, the piston sub-assembly, and the cutting sub-assembly and including at least one set of slips moveable to engage the cut portion of the casing.

In an aspect combinable with the example implementation, the piston sub-assembly includes a motor; and a shaft assembly that includes a shaft coupled to the motor and a plurality of disk assemblies, each disk assembly including a disk coupled to the shaft and at least one of the plurality of pistons.

In another aspect combinable with any of the previous aspects, each disk assembly includes a pair of pistons, each piston of the pair of pistons coupled to the disk through a jointed arm.

In another aspect combinable with any of the previous aspects, the motor is configured to rotate each disk about the shaft to alternatingly extend and withdraw each piston of the pair of pistons into and out of contact with the portion of the casing installed in the wellbore to at least de-bond the portion of the cement layer installed between the portion of the casing and the subterranean formation from the portion of the casing.

In another aspect combinable with any of the previous aspects, the plurality of pistons are configured to moveably contact the portion of the casing installed in the wellbore to break the portion of the cement layer installed between the portion of the casing and the subterranean formation.

In another aspect combinable with any of the previous aspects, the cutting sub-assembly includes a plurality of cutting blades configured to spin about the downhole tool to cut through the portion of the casing adjacent the de-bonded portion of the cement layer.

In another aspect combinable with any of the previous aspects, the at least one set of slips includes a plurality of sets of slips moveable to engage the cut portion of the casing.

In another aspect combinable with any of the previous aspects, each set of the sets of slips includes a plurality of gripping teeth configured to engage and hold the cut portion of the casing.

In another aspect combinable with any of the previous aspects, each set of the sets of slips is configured to expand away from the downhole tool and toward the cut portion of the casing.

In another example implementation, a method for removing a portion of a tubular from a wellbore includes running a downhole tool on a downhole conveyance into a wellbore formed from a terranean surface into a subterranean formation; activating a piston sub-assembly of the downhole tool to repeatedly move a plurality of pistons to contact a portion of a casing installed in the wellbore to at least de-bond a portion of a cement layer installed between the portion of the casing and the subterranean formation from the portion of the casing; activating a cutting sub-assembly of the downhole tool to move at least one cutting blade to cut through the portion of the casing adjacent the de-bonded portion of the cement layer; activating a hanger sub-assembly of the downhole tool to move at least one set of slips into contacting engagement with the cut portion of the casing; and running the downhole tool on the downhole conveyance out of the wellbore with the cut portion of the casing engaged with the at least one set of slips.

In an aspect combinable with the example implementation, activating the piston sub-assembly of the downhole tool includes activating a motor to rotate at least one shaft coupled to the motor; rotating a shaft assembly coupled to the at least one shaft to spin a plurality of disk assemblies, each disk assembly including at least one of the plurality of pistons; and oscillating the at least one of the plurality of pistons to contact the portion of the casing installed in the wellbore by spinning the plurality of disk assemblies.

In another aspect combinable with any of the previous aspects, each disk assembly includes a pair of pistons coupled to at least one disk of the disk assembly through a jointed arm, and oscillating the at least one of the plurality of pistons to contact the portion of the casing installed in the wellbore by spinning the plurality of disk assemblies includes oscillating the pair of pistons to contact the portion of the casing and another portion of the casing that is angularly offset from the portion of the casing.

In another aspect combinable with any of the previous aspects, oscillating the pair of pistons to contact the portion of the casing and another portion of the casing that is angularly offset from the portion of the casing includes alternatingly extending and withdrawing each piston of the pair of pistons into and out of contact with the portion of the casing and the another portion of the casing to at least de-bond portions of the cement layer installed between the portion of the casing and the subterranean formation and the another portion of the casing and the subterranean formation.

Another aspect combinable with any of the previous aspects further includes activating the piston sub-assembly of the downhole tool to repeatedly move the plurality of pistons to contact the portion of a casing installed in the wellbore to break the portion of the cement layer installed between the portion of the casing and the subterranean formation.

In another aspect combinable with any of the previous aspects, activating the cutting sub-assembly of the downhole tool to move at least one cutting blade includes rotating a plurality of cutting blades about the downhole tool to cut through the portion of the casing adjacent the de-bonded portion of the cement layer.

In another aspect combinable with any of the previous aspects, activating the hanger sub-assembly of the downhole tool to move at least one set of slips into contacting engagement with the cut portion of the casing includes extending an arm of the at least one set of slips toward the cut portion of the casing; and gripping the cut portion of the casing with a plurality of teeth of the at least one set of slips that are attached to the arm.

Another aspect combinable with any of the previous aspects further includes, while activating the piston sub-assembly of the downhole tool to repeatedly move the plurality of pistons to contact the portion of a casing installed in the wellbore: moving the downhole tool uphole or downhole in the wellbore to another position adjacent another portion of the casing installed in the wellbore; and repeatedly moving the plurality of pistons to contact the another portion of the casing installed in the wellbore to at least de-bond the another portion of the cement layer installed between the another portion of the casing and the subterranean formation from the another portion of the casing.

Another aspect combinable with any of the previous aspects further includes, subsequent to activating the cutting sub-assembly of the downhole tool to move the at least one cutting blade to cut through the portion of the casing adjacent the de-bonded portion of the cement layer: deactivating the cutting sub-assembly of the downhole tool to stop movement of the at least one cutting blade; moving the downhole tool uphole or downhole in the wellbore adjacent the another portion of the casing; and re-activating the cutting sub-assembly of the downhole tool to move the at least one cutting blade to cut through the another portion of the casing adjacent the de-bonded another portion of the cement layer.

Another aspect combinable with any of the previous aspects further includes activating the hanger sub-assembly of the downhole tool to move the at least one set of slips into contacting engagement with the cut portion of the casing between the portion of the casing and the another portion of the casing.

In another example implementation, a downhole tool system includes a connector configured to couple to a means for conveying the downhole tool system into and out of a wellbore; means for repeatedly contacting a portion of a casing installed in the wellbore to at least de-bond a portion of a cement layer installed between the portion of the casing and a rock formation; means for cutting through the portion of the casing adjacent the de-bonded portion of the cement layer; and means for engaging the cut portion of the casing to retrieve the cut portion of the casing from the wellbore.

In an aspect combinable with the example implementation, the means for repeatedly contacting the portion of the casing is configured to be hydraulically activated or mechanically activated.

In another aspect combinable with any of the previous aspects, the means for cutting through the portion of the casing includes one or more extendable cutting blades.

Another aspect combinable with any of the previous aspects further includes a bore that extends through the means for repeatedly contacting the portion of the casing, the means for cutting through the portion of the casing, and the means for engaging the cut portion of the casing.

In another aspect combinable with any of the previous aspects, the bore includes a fluid pathway for a hydraulic fluid configured to activate at least one of the contacting the portion of the casing, the means for cutting through the portion of the casing, or the means for engaging the cut portion of the casing.

In another aspect combinable with any of the previous aspects, the means for repeatedly contacting the portion of the casing installed in the wellbore is configured to fracture the portion of the cement layer installed between the portion of the casing and the rock formation.

Implementations of a downhole tool for removing at least a portion of a tubular from a wellbore according to the present disclosure may include one or more of the following features. For example, a downhole tool can retrieve any cemented casing (production casing), to be able to recover the well and drill completely new path. As another example, a downhole tool can include multiple sub-assemblies to remove a portion of a casing, such as a cutting sub-assembly, an impact sub-assembly, and a latching/pulling sub-assembly. As another example, a downhole tool can include a bore there though to facilitate a circulation of fluids within a tool string and through the tool. As a further example, a downhole tool can be operated in different applications, such as retrieving stuck casing during deployment as well as removing a portion of casing for sidetracks. As a further example, a downhole tool can have sub-assemblies that can be used separately or combined in any sequence depending on job-specific objectives.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
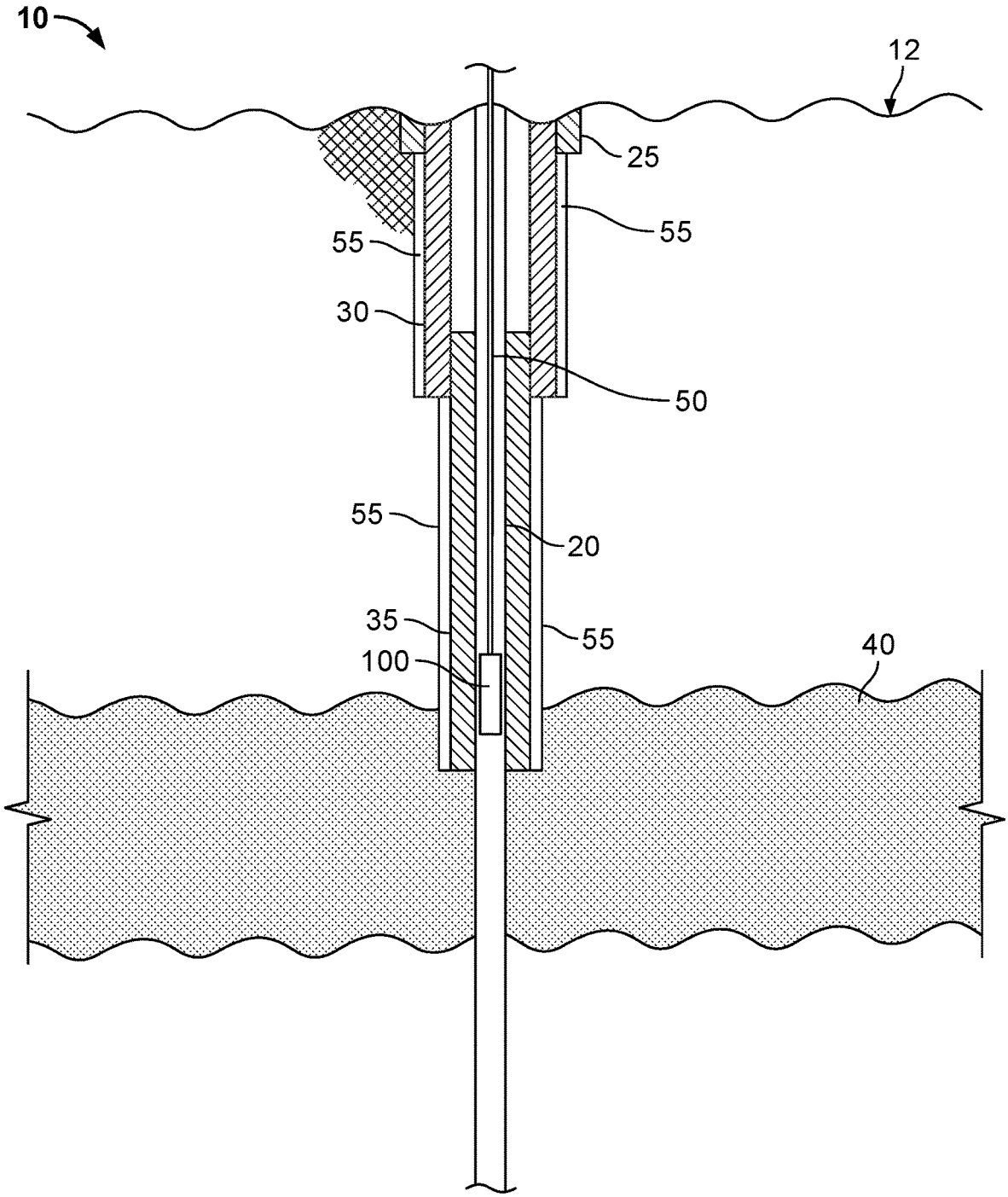
FIG. 1 is a schematic diagram of a downhole tool for removing at least a portion of a tubular from a wellbore according to the present disclosure.

FIG. 1 is a schematic diagram of wellbore system 10 that includes a downhole tool 100 according to the present disclosure. Generally, FIG. 1 illustrates a portion of one embodiment of a wellbore system 10 according to the present disclosure in which the downhole tool 100 may be run into a wellbore 20 and activated during the run in (or run out) process or when the tool 100 reaches a particular location within the wellbore 20. In this example, the downhole tool 100 is coupled to a downhole conveyance 50, such as a tubing string, coiled tubing, wireline, or other conveyance that, in some aspects, may facilitate the transmission of movement, fluid, or both to and from the downhole tool 100 while in the wellbore 20. Generally, and as described in more detail herein, the downhole tool 100 to de-bond (or break apart) cement around a wellbore tubular (such as a casing), cut the wellbore tubular at a desired depth at which the cement is de-bonded, and retrieve the cut casing to a terranean surface 12.

As shown, the wellbore system 10 accesses a subterranean formation 40 that provides access to hydrocarbons located in such subterranean formation 40. A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as an intermediate casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 can be the intermediate casing 30. The intermediate casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Other casings, not specifically shown in this figure, can be included within the wellbore system 10 without departing from the scope of this disclosure. Further, other tubulars (such as liners or otherwise), along with casings, can generally be referred to as "wellbore tubulars" in the present disclosure.

As shown in FIG. 1, a cement layer 55 (or cement 55) is installed in an annulus between each illustrated casing (conductor casing 25, intermediate casing 30, and production casing 35) and the adjacent geologic formation (such as subterranean formation 40). Cement 55 can be circulated downward, during the construction of the wellbore system 10, through one or more casings and back upward into the annulus between the particular casing and the adjacent geologic formation in order to, for example, bond the casing to the formation. Once solidified in the annulus, the cement 55 can provide a barrier to fluid entry into the wellbore 20 as well as maintain the casings in place.

Figure 2:
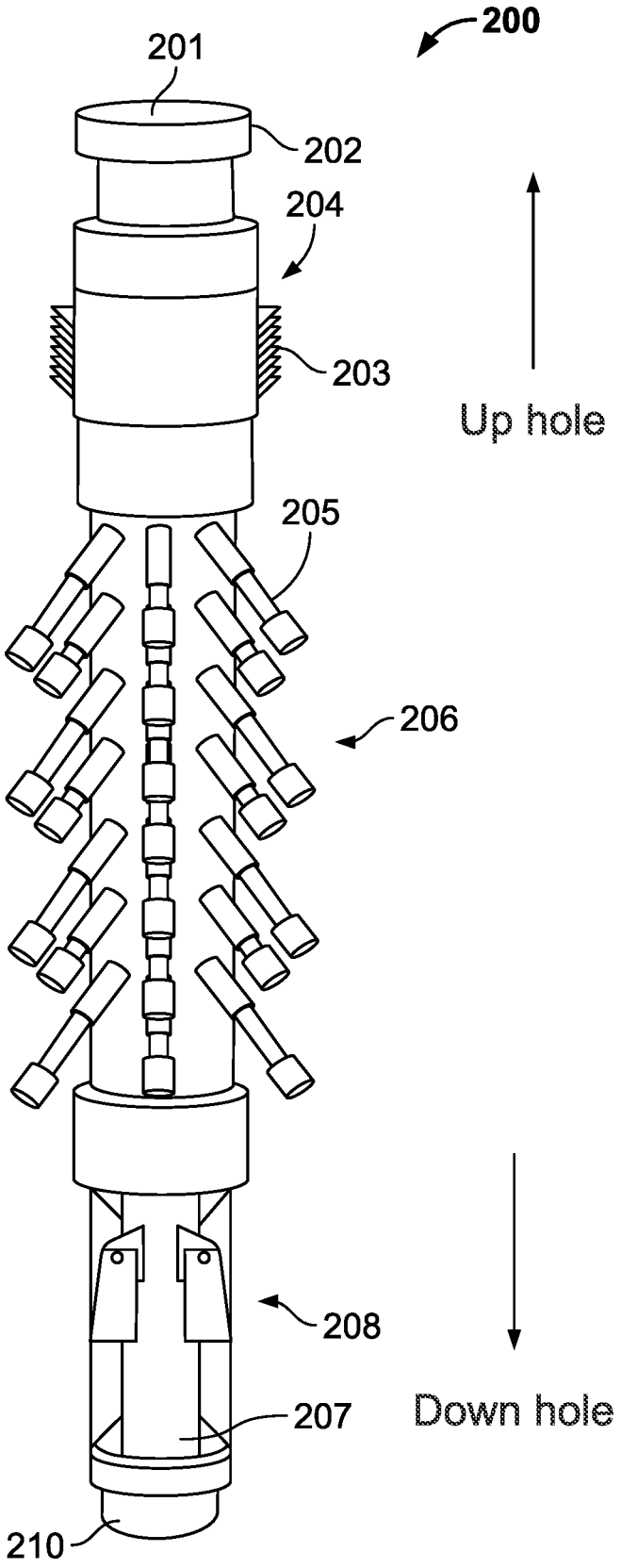
FIG. 2 is a schematic diagram of an example implementation of the downhole tool of FIG. 1 according to the present disclosure.

FIG. 2 is a schematic diagram of an example implementation of a downhole tool 200, which can be used as downhole tool 100 in the wellbore system 10 of FIG. 1 according to the present disclosure. As shown in FIG. 2, the downhole tool 200 is comprised of multiple sub-assemblies that are coupled together to form the tool 200, which, in this example, includes a bore 201 that extends through at least a portion of a length of the downhole tool 200 and through one or more of the sub-assemblies (such as, for fluid circulation there through).

In this example implementation, the downhole tool 200 includes a top sub-assembly 202 that is configured to attach to or couple with the downhole conveyance 50 shown in FIG. 1 (for example, a tubing string, coiled tubing, wireline, or otherwise). In some aspects, the top sub-assembly 202 includes a threaded connection to the downhole conveyance 50, which facilitates fluid flow from the downhole conveyance 50 into the bore 201 (such as, to activate one or more of the sub-assemblies of the downhole tool 200).

This example implementation of the downhole tool 200 also includes a hanger sub-assembly 204 that is coupled with the top sub-assembly 202. The hanger sub-assembly 204 includes one or more slips 203 or other profile sets that are designed to attach to or otherwise grad a portion of a wellbore tubular, such as a casing. Generally, the hanger sub-assembly 204 operates subsequent to cutting a portion of a wellbore tubular (which has been de-bonded from the cement 55) and latches into the portion of the wellbore tubular for retrieval (for example, to the terranean surface 12). In this example, the slips 203 are angled in an uphole direction in order to actively engage when in contact with the portion of the wellbore tubular. Thus, a weight of the portion of the wellbore tubular further engage the slips 203 into the material of the tubular to insure a sufficient attachment such that the portion of the wellbore tubular does not fall into the wellbore 20 during retrieval.

This example implementation of the downhole tool 200 also includes a piston sub-assembly 206 that is coupled with the hanger sub-assembly 204. In this example, the piston sub-assembly 206 includes multiple piston assemblies (also called pistons) 205 that extend from the downhole tool 200 and are arranged, in this example, in generally linear arrays along a length of the piston sub-assembly 206. Generally, the piston sub-assembly 206 operates to de-bond the cement 55 behind a particular portion of a wellbore tubular (such as production casing 35) through a hammering effect. In some aspects, the piston sub-assembly 206 operates to break apart (such as, fracture) the cement 55 behind the particular portion of the wellbore tubular. The piston assemblies 205 act, for example, in an oscillating fashion and interchangeably to deliver instantaneous hammering forces to the wellbore tubular (such as production casing 35). In some aspects, the hammering forces can be at least 3,000 pounds per square inch (psi) against the wellbore tubular in order to break down the solidified cement bonds with the tubular. In some aspects, the piston sub-assembly 206 is rotatable about a longitudinal axis of the downhole tool 200 during operation of the piston assemblies 205.

This example implementation of the downhole tool 200 also includes a cutting sub-assembly 208 that is coupled with the piston sub-assembly 206. As shown, the cutting sub-assembly 208 includes one or more cutting blades 207 that are extendable from the downhole tool 200 and configured to cut or break through a wellbore tubular, such as a casing. In some aspects, the cutting sub-assembly 208 comprises a hydraulic or mechanical casing-cutting tool, which, after run to a desired cutting depth, can be activated hydraulically (for example, by pressure of a fluid circulated through the bore 201) or mechanically (for example, by rotating or slacking the downhole tool 200, or both).

This example implementation of the downhole tool 200 also includes a bottom sub-assembly 210 that is coupled with the cutting sub-assembly 208. In some aspects, the bottom sub-assembly 210 comprises a downhole termination of the downhole tool 200. Alternatively, the bottom sub-assembly 210 can provide a location to couple or attach further sub-assemblies or tools to the downhole tool 200. Although this example implementation of the downhole tool 200 provides, from uphole end to downhole end, the hanger sub-assembly 204, the piston sub-assembly 206, and the cutting sub-assembly 208, other example implementations of the downhole tool 200 may an a rearranged order (from uphole end to downhole end) of such sub-assemblies.

Figure 3A:
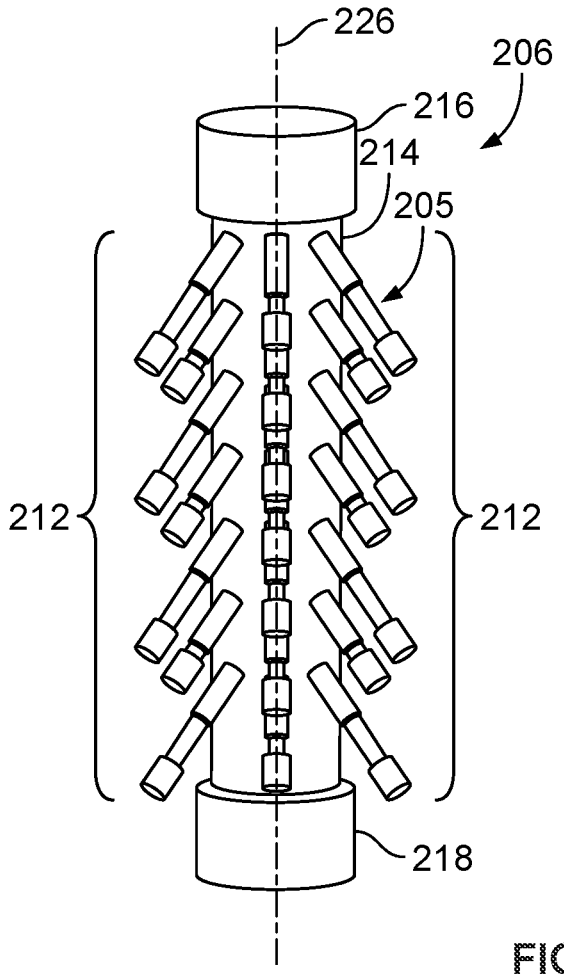
FIGS. 3A-3G are schematic diagrams of a piston sub-assembly of the downhole tool of FIG. 2 according to the present disclosure.
Figure 3B:
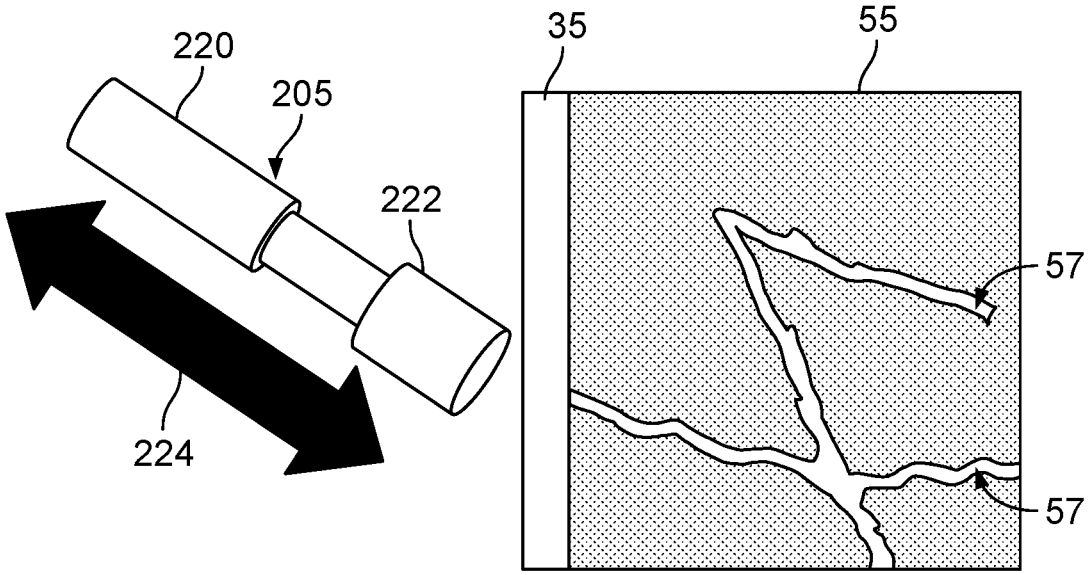
Figure 3E:
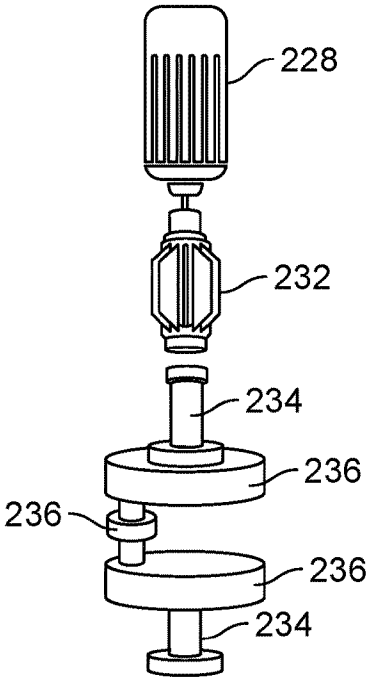
Figure 3D:
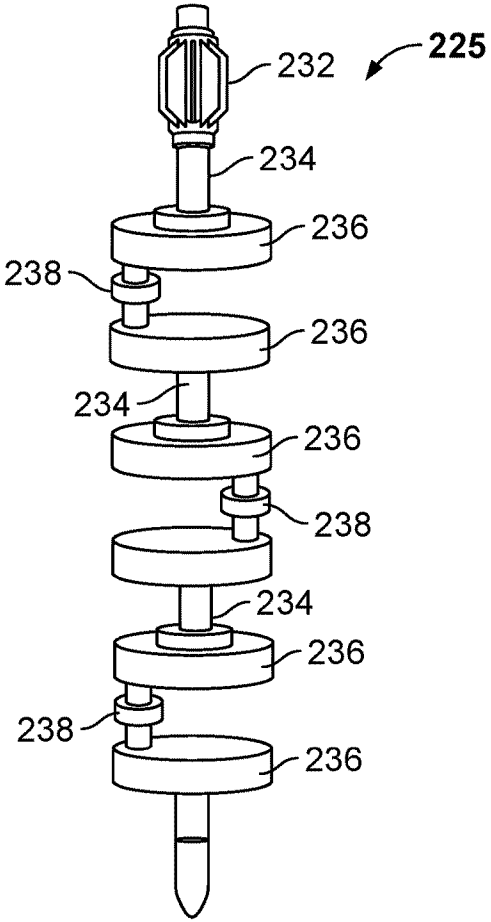
Figure 3C:
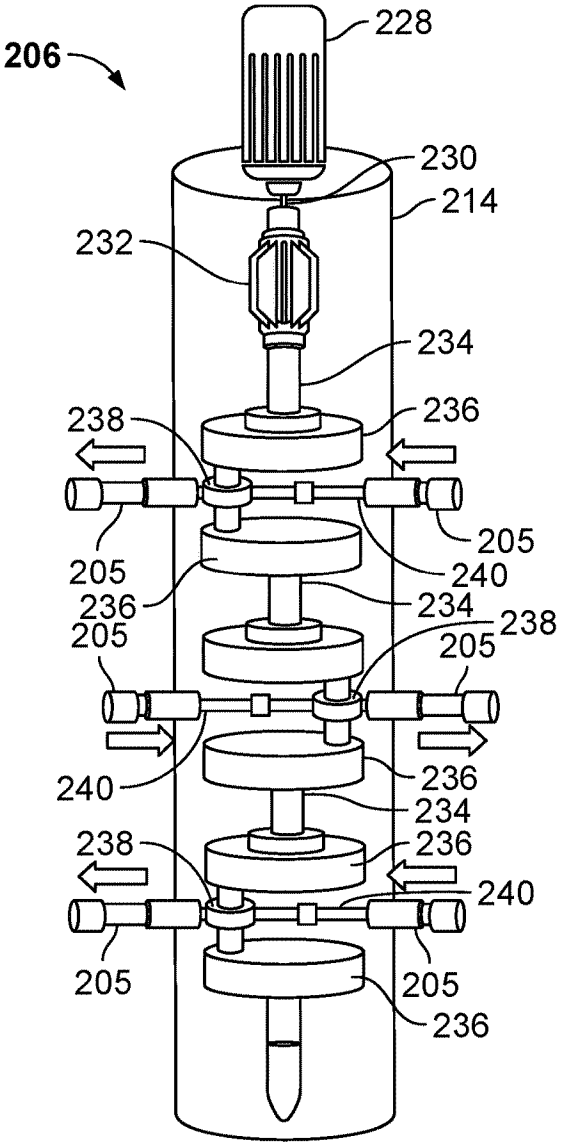
Figure 3G:
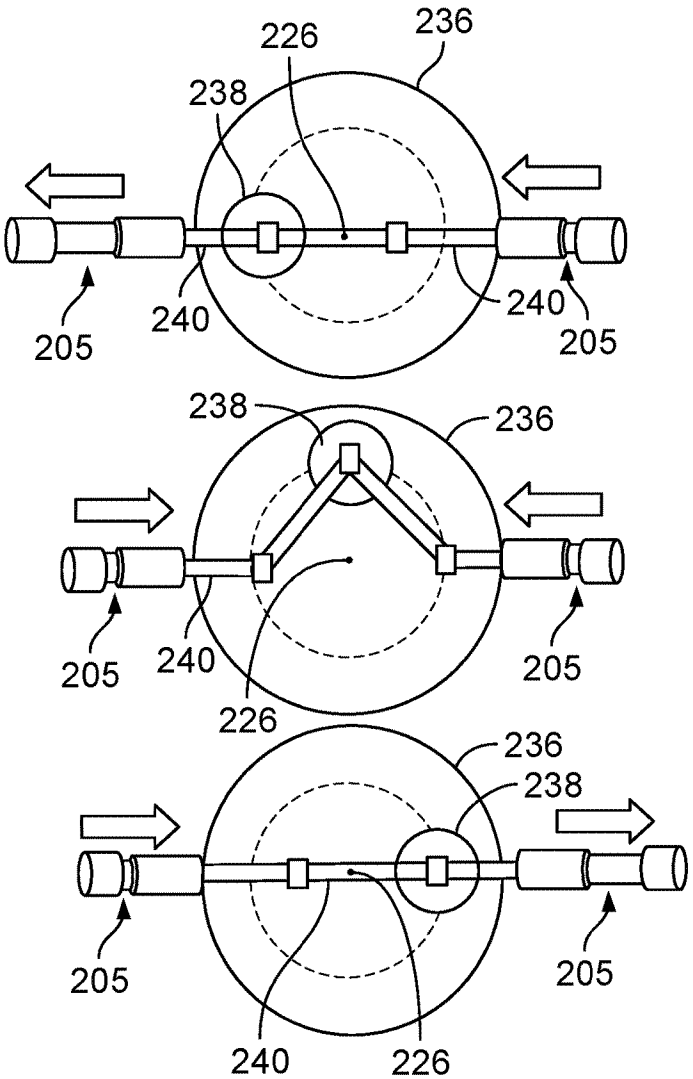
Figure 3F:
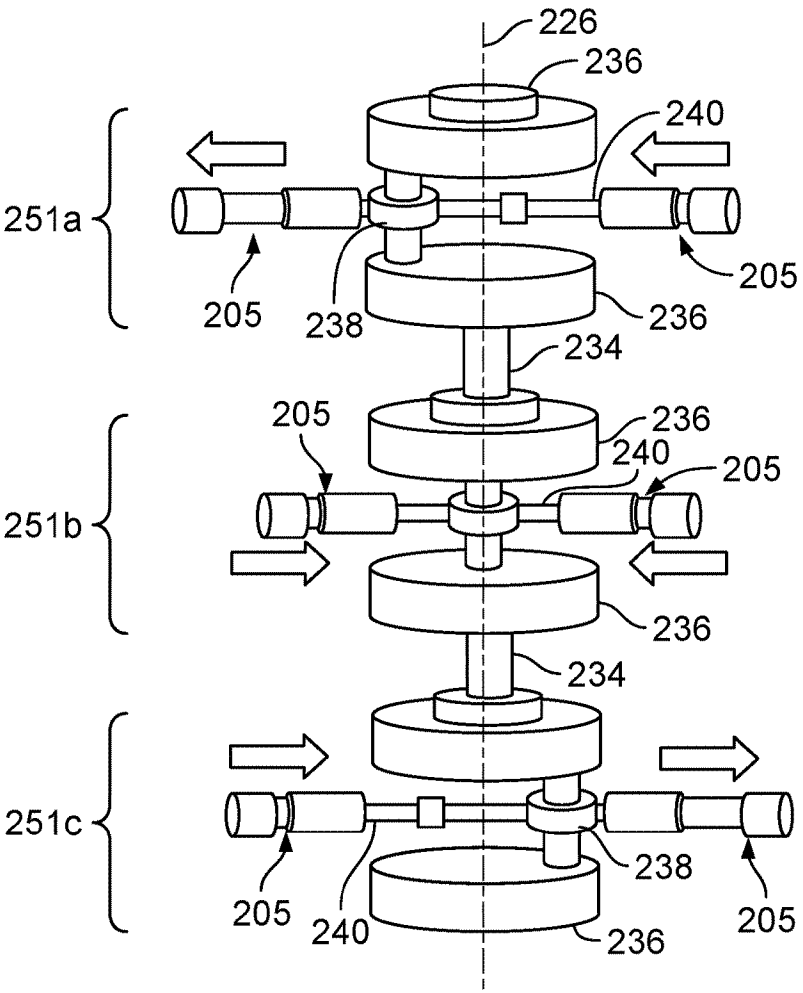

FIGS. 3A-3G are schematic diagrams of the piston sub-assembly 206 of the downhole tool 200 according to the present disclosure. FIG. 3A shows a side view of the piston sub-assembly 206. FIG. 3B shows a schematic illustration of a piston assembly 205 in contact with the production casing 35 to de-bond the casing 35 from the cement 55. FIGS. 3C-3E show exploded views of components of the piston sub-assembly 206. FIGS. 3F-3G show an example operation of the piston sub-assembly 206.

Turning to FIG. 3A, as shown, the piston sub-assembly 206 includes a top coupling 216 that connects the piston sub-assembly 206 to the hanger sub-assembly 204, a bottom coupling 218 that connects the piston sub-assembly 206 to the cutting sub-assembly 208, and a housing 214 in which one or more disk assemblies (described later) are enclosed). Arrays 212 of the piston assemblies 205 are arranged vertically on the housing 214, as the piston assemblies 205 that connected to the disk assemblies extend through the housing 214. In this example, each array 212 (three shown here) are aligned with a centerline 226 of the piston sub-assembly 206 (which also is a centerline 226 of the downhole tool 200, itself).

As shown in FIG. 3B, oscillating movement 224 of the piston assembly 205 during operation of the piston sub-assembly 206 acts to hammer the production casing 35 with a piston head 222 of the piston assembly 205. In this example, the piston assembly 205 includes the piston head 22, which oscillates into and out of a piston cylinder 220 during the oscillating movement 224 (as explained in more detail later). In response to the hammer forces on the casing 35, the cement 55 can be de-bonded from the production casing 35 at and adjacent a location in which the contact of the piston assembly 205 occurs. In addition, in some aspects, one or more cracks 57 can be formed in the cement 55 at and adjacent a location in which the contact of the piston assembly 205 occurs.

Turning now to FIGS. 3C-3E, other components of the piston sub-assembly 206 are shown. For example, as shown, a motor 228 is drivably coupled to a shaft assembly 225 (shown isolated in FIG. 3D), which operates to drive the oscillating movement of each of the piston assemblies 205 during operation of the piston sub-assembly 206. In this example, the motor 228 can be an electric motor that receives power from, for example, an electric power source within the downhole tool 200 or from electrical power provided through the downhole conveyance 50. Alternatively, the motor 228 can be a hydraulic motor that transfers power to the shaft assembly 225 from a circulating fluid through the downhole tool 200.

The shaft assembly 225 includes a motor coupling 232 that attaches to a motor shaft 230 of the motor 228 to receive rotational power from the motor 228 to the rest of the shaft assembly 225. In this example, the shaft assembly 225 includes multiple disks 236 that are interconnected with couplings 238 or shaft segments 234 (as shown). For instance, a pair of adjacent disks 236 are rotatingly coupled together with a coupling 238 that is attached at or near a perimeter portion of each disk 236, while a next pair of adjacent disks 236 are rotatingly coupled together with a shaft segment 234 that is attached at or near a radial center of each disk 236. Thus, rotational movement driven by the motor 228 can be transferred to the motor coupling 232, and then alternatingly to each of the disks 236 through segment shafts 234 or couplings 238, respectively.

As shown in FIG. 3C, a linkage 240 is coupled to a pair of piston assemblies 205 (one on each end of the linkage 240) and through each coupling 238. In some aspects, each linkage 240 is hinged so as to allow angular pivoting of the linkage 240 during rotational movement of the disks 236 to which the coupling 238 is attached (as explained in more detail with reference to FIGS. 3F and 3G).

Turning now to FIGS. 3F and 3G, an example operation of the shaft assembly 225 of the piston sub-assembly 206 is illustrated. FIG. 3F shows a side view of the components of the shaft assembly 225 during operation (for example, rotation driven by the motor 228, while FIG. 3G shows a top view of each pair of disks 236 that are connected by a particular coupling 238. Generally, as each coupling 238 is rotated by rotational motion caused by the motor 228, each piston assembly 205 of the pair of piston assemblies 205 connected through the coupling 238 oscillates toward and away from the centerline 226 of the piston sub-assembly 206 (and downhole tool 200).

For example, as shown in this figure, three disk assemblies 251*a-c* are illustrated (but more or fewer disk assemblies can be included in alternative implementations of the piston sub-assembly 206. As shown, the disk assembly 251*a* has a coupling 238 that, as shown, is at a "9 o'clock" position as shown in the top view of FIG. 3G. In this position, a left side (looking in both side and top views) piston assembly 205 is moving away from the centerline 226 and toward, for example, a first portion of a wellbore tubular, such as a casing, in order to hammer the casing to de-bond cement behind the tubular. As the left side piston assembly 205 is moving, for example, the piston head 22 is forcibly extended from the cylinder 220 (as shown by the arrow). In this position, a right side (looking in both side and top views) piston assembly 205 is moving toward the centerline 226 and away from, a second portion of the wellbore tubular (that is 180° apart from the first portion). As the right side piston assembly 205 is moving, for example, the piston head 22 is forcibly withdrawn into the cylinder 220 (as shown by the arrow).

As further shown, the disk assembly 251*b* has a coupling 238 that, as shown, is at a "12 o'clock" position as shown in the top view of FIG. 3G. In this position, a left side (looking in both side and top views) piston assembly 205 is moving toward the centerline 226 and away from, the first portion of the wellbore tubular. As the left side piston assembly 205 is moving, for example, the piston head 222 is forcibly withdrawn into the cylinder 220 (as shown by the arrow). In this position, a right side (looking in both side and top views) piston assembly 205 is moving toward the centerline 226 and away from, the second portion of the wellbore tubular. As the right side piston assembly 205 is moving, for example, the piston head 22 is forcibly withdrawn into the cylinder 220 (as shown by the arrow).

As shown, the disk assembly 251*c* has a coupling 238 that, as shown, is at a "3 o'clock" position as shown in the top view of FIG. 3G. In this position, a left side (looking in both side and top views) piston assembly 205 is moving toward the centerline 226 and away from the first portion of the wellbore tubular. As the left side piston assembly 205 is moving, for example, the piston head 222 is forcibly withdrawn into the cylinder 220 (as shown by the arrow). In this position, a right side (looking in both side and top views) piston assembly 205 is moving away from the centerline 226 and toward, for example, the second portion of a wellbore tubular in order to hammer the casing to de-bond cement behind the tubular. As the right side piston assembly 205 is moving, for example, the piston head 222 is forcibly extended from the cylinder 220 (as shown by the arrow).

Figure 4B:
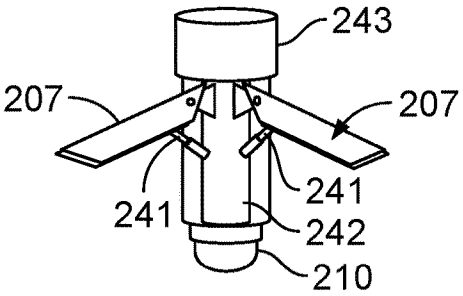
FIGS. 4A-4C are schematic diagrams of a cutting sub-assembly of the downhole tool of FIG. 2 according to the present disclosure.
Figure 4C:
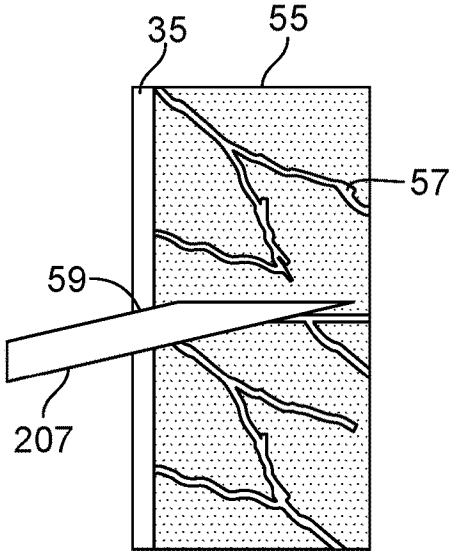
Figure 4A:
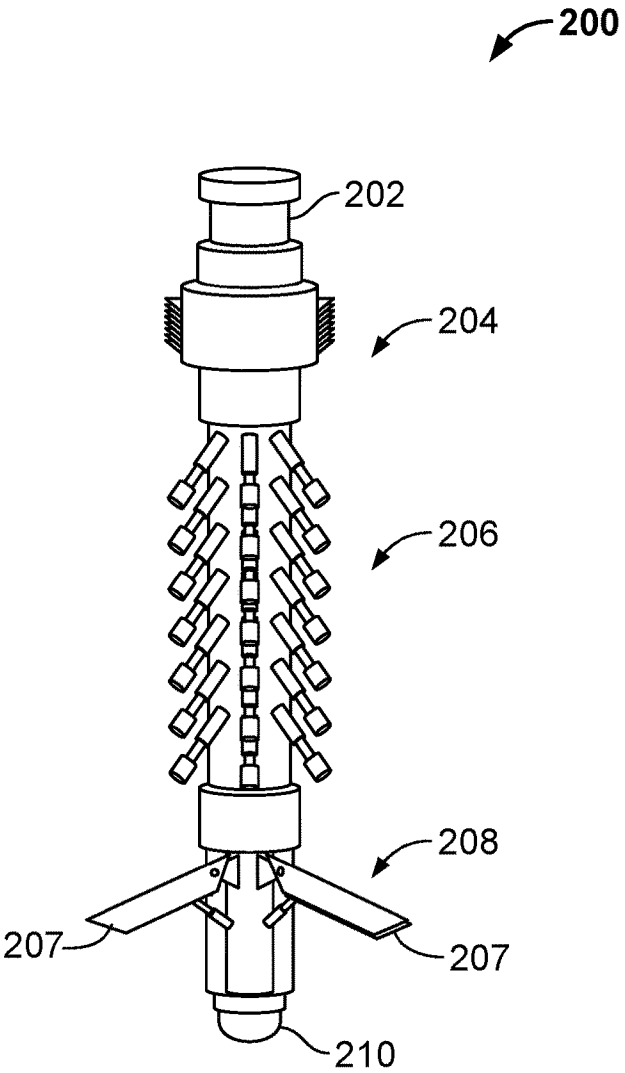

FIGS. 4A-4C are schematic diagrams of the cutting sub-assembly 208 of the downhole tool 200 according to the present disclosure. Briefly, as shown in FIG. 4A, during operation of the cutting sub-assembly 208, the one or more cutting blades 207 are extended away from the downhole tool 200 in order to, for example, contact and cut through a wellbore tubular, such as a casing that has been de-bonded from cement. FIG. 4B shows a side, isolated view of the cutting sub-assembly 208. As shown, this example of the cutting sub-assembly 208 includes a top coupling 243 that connects the cutting sub-assembly 208 to the piston sub-assembly 206. In this example, the bottom sub-assembly 210 is coupled to the cutting sub-assembly 208. Each cutting blade 207 is attached through a retractable arm 241 to a mandrel 242 of the cutting sub-assembly 208.

In some aspects, the cutting sub-assembly 208 can be hydraulically actuated. For example, a hydraulic fluid can be circulated to the tool downhole tool through the bore 201 and to the cutting sub-assembly 208 in order to generate a piston force to extend the retractable arms 241 to extend the cutting blades 207 from the mandrel 242. The hydraulic fluid can also rotate the cutting sub-assembly 208 (or only the cutting blades 207) to penetrate the wellbore tubular (such as a casing) to create a clean cut around an inner diameter of the tubular (adjacent the cement).

In some aspects, the cutting sub-assembly 208 can be mechanically actuated. For example, a mechanical signal, such as rotation of weight slacking, can be provided to the downhole tool 200 to facilitate extension of the retractable arms 241 to extend the cutting blades 207 away from the cutting sub-assembly 208. The cutting sub-assembly 208 or the downhole tool 200, itself, can then be rotated (for example, by the downhole conveyance 50) to penetrate the wellbore tubular (such as a casing) to create a clean cut around an inner diameter of the tubular (adjacent the cement). For example, as shown in FIG. 4C, the cutting blade 207 has penetrated the production casing 35 (and into the de-bonded cement 55) to create a cut 59 of the production casing 35.

Figure 5:
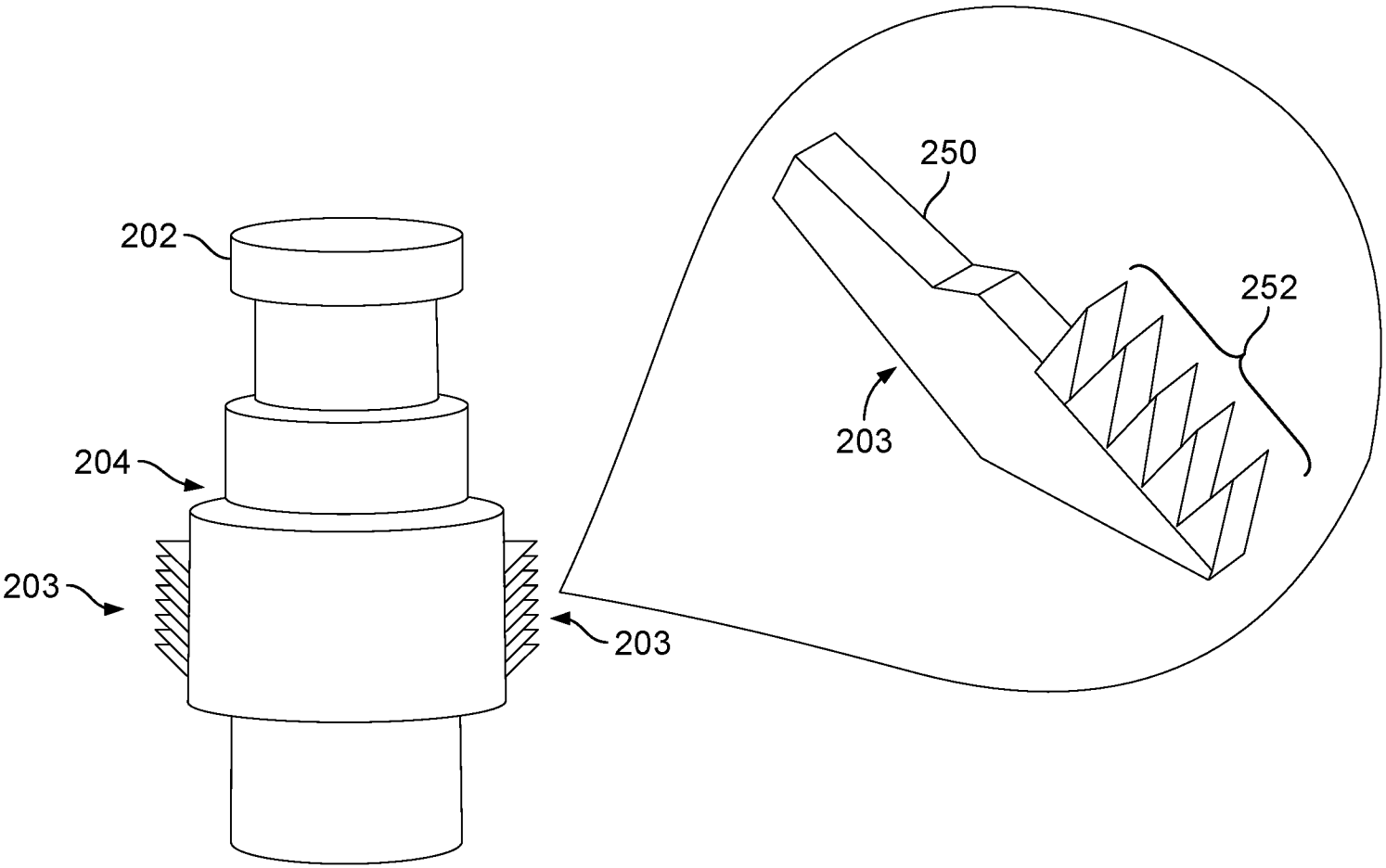
FIG. 5 is a schematic diagram of a hanger sub-assembly of the downhole tool of FIG. 2 according to the present disclosure.

FIG. 5 is a schematic diagram of the hanger sub-assembly 204 of the downhole tool 200 according to the present disclosure. In this figure, two sets of slips 203 are shown, however, the hanger sub-assembly 204 can have more or fewer sets of slips 203. Generally, the slips 203 include a profile (such as teeth or other repeating set of protrusions) that can attach to a portion of a wellbore tubular that has been de-bonded from cement in the wellbore. For instance, as shown in the callout of FIG. 5, teeth 252 are formed or coupled to an arm 250. The arm 250 is extendable and retractable from the hanger sub-assembly 204 by, for example, a hydraulic or mechanical activation.

Figure 6:
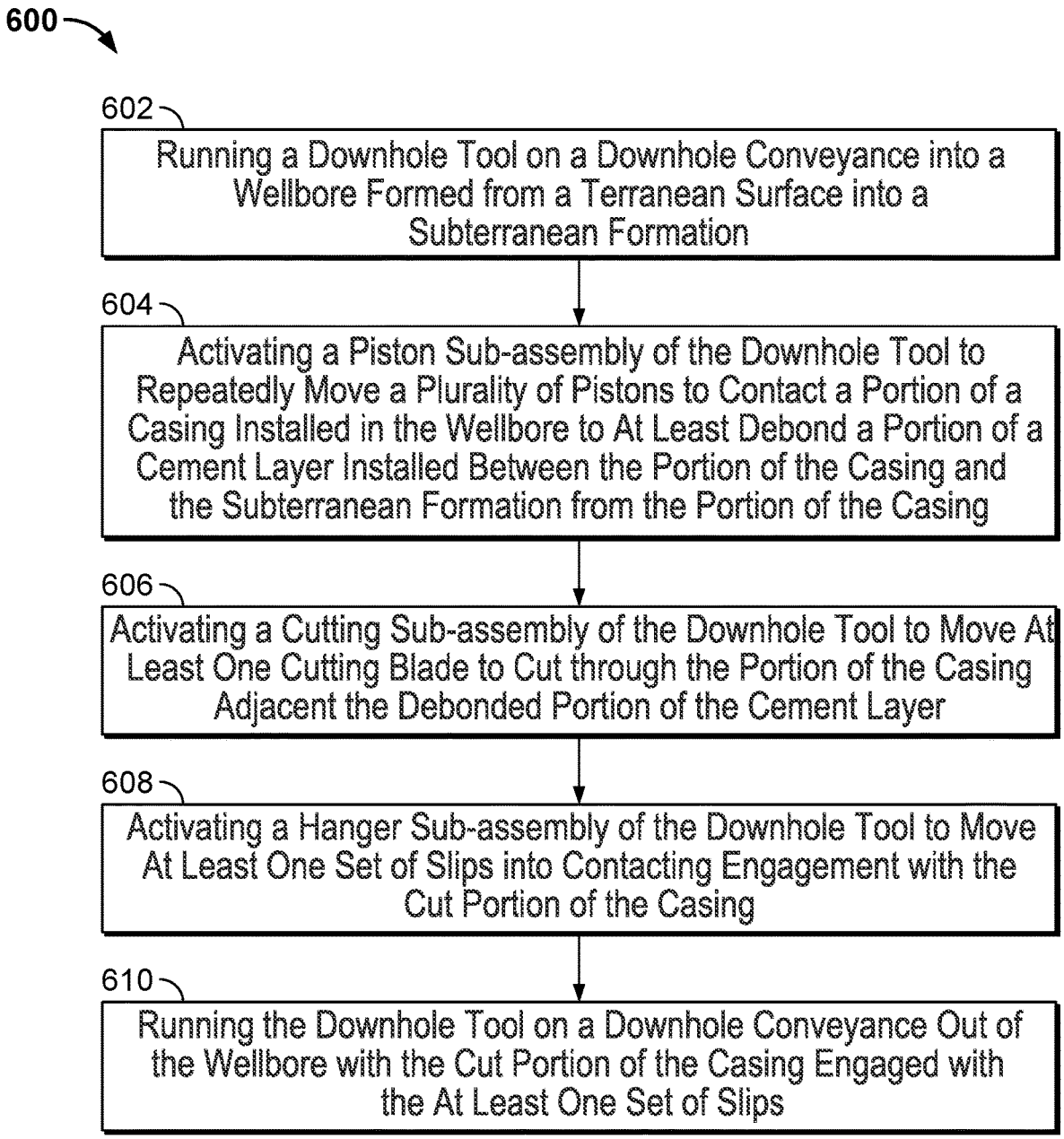
FIG. 6 is a flowchart that illustrates an example method performed with the downhole tool of FIG. 2 according to the present disclosure.

FIG. 6 is a flowchart that illustrates an example method 600 performed with the downhole tool 200 of FIG. 2 according to the present disclosure. Method 600 can begin at step 602, which includes running a downhole tool on a downhole conveyance into a wellbore formed from a terranean surface into a subterranean formation. For example, turning to FIG. 7A, the downhole tool 200 can be run into the wellbore on the downhole conveyance 50, which can be, for example, a tubular work string, coiled tubing, wireline, or other conveyance that is operable to move the downhole tool 200 uphole and downhole in the wellbore. In some aspects, the downhole conveyance 50 moves the downhole tool 200 into the wellbore to a particular location adjacent a portion of the production casing 35, which is attached to a subterranean, or rock, formation, with the cement layer 55. In some aspects, the particular location is a location in which a sidetrack (or lateral) from the wellbore is to be formed.

Figure 7B:
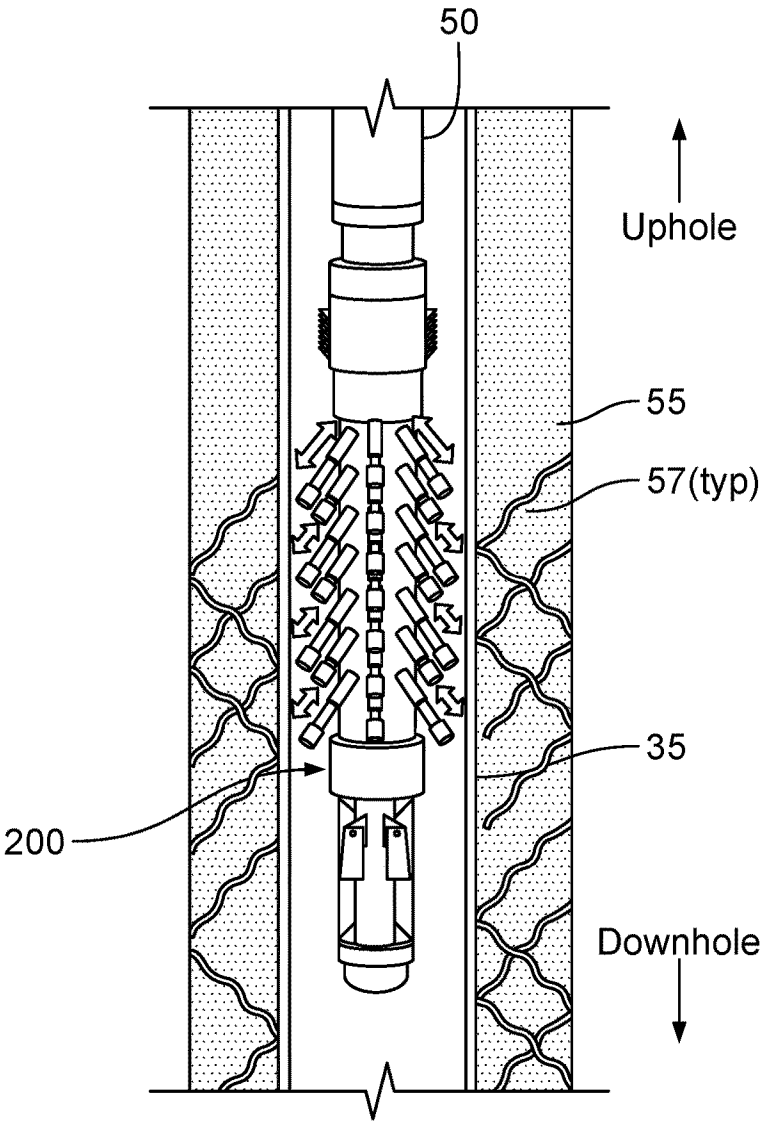
FIGS. 7A-7D are schematic diagrams illustrating one or more of the example steps of the method of FIG. 6 according to the present disclosure.
Figure 7A:
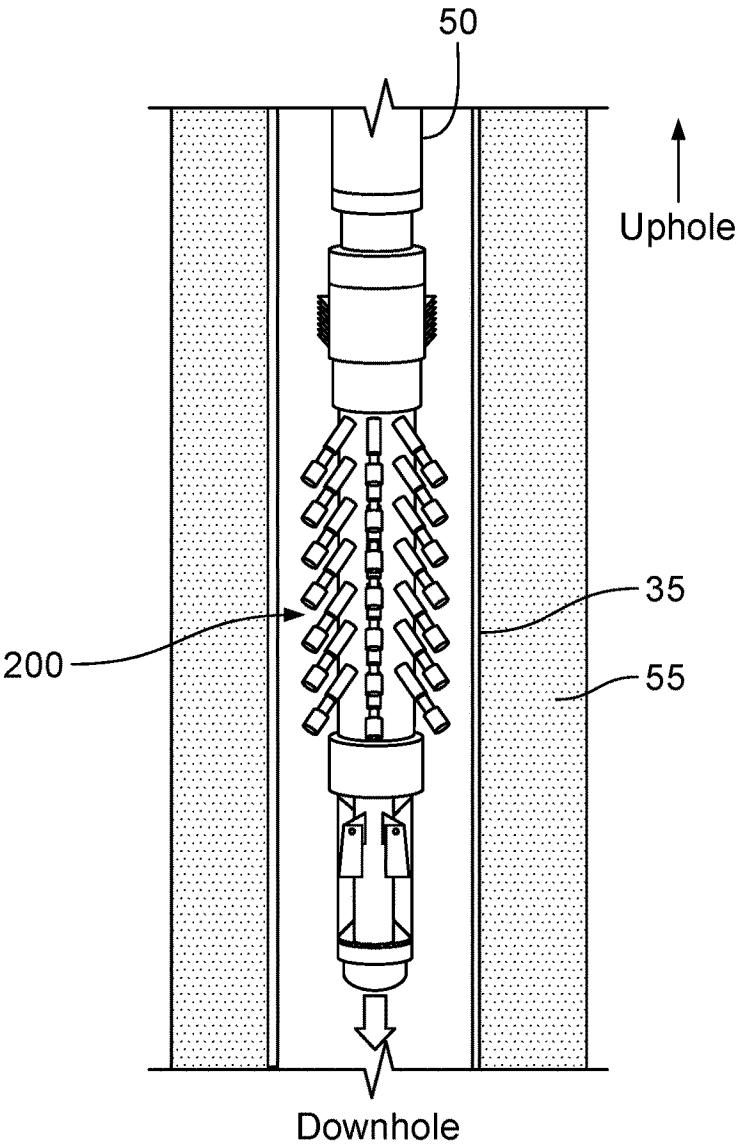

Method 600 can continue at step 604, which includes activating a piston sub-assembly of the downhole tool to repeatedly move a plurality of pistons to contact a portion of a casing installed in the wellbore to at least de-bond a portion of a cement layer installed between the portion of the casing and the subterranean formation from the portion of the casing. For example, turning to FIG. 7B, once at the particular location in the wellbore adjacent the portion of the production casing 35, a piston sub-assembly 206 can be activated (for example, hydraulically or mechanically) to repeatedly move the piston assemblies 205 into and out of hammering contact with the portion of the production casing 35 (as also described with reference to FIGS. 3C-3G). Other components can also be used in place of the described piston assemblies 205 to repeatedly move the piston assemblies 205 into and out of hammering contact with the portion of the production casing 35. For example, rather than use piston-cylinder assemblies as described with reference to the piston assemblies 205, in which the piston head oscillates into and out of the piston cylinder, a simple piston head (without the cylinder) can be oscillated back and forth by the piston sub-assembly 206 to repeatedly hammer the production casing 35. Other, pointed or rounded protrusions rather than piston heads can be used to repeatedly hammer the production casing 35. As shown in FIG. 7B, due to the repeated movement of the piston assemblies 205 into and out of hammering contact with the portion of the production casing 35, the cement layer 55 is de-bonded from the portion of the production casing 35 and, as shown, can also incur fractures 57.

In some aspects, the downhole tool 200 can be moved uphole or downhole (or both directions, once or repeatedly) during step 604. For example, the downhole conveyance 50 can be operated to move the downhole tool 200 in either direction such that the piston sub-assembly 206 operates to repeatedly move the piston assemblies 205 into and out of hammering contact with a particular length of the production casing 35 to de-bond (or fracture) the cement layer 55 behind the production casing 35. In addition, in some aspects, the downhole tool 200 can be rotated in the wellbore during step 604 (for example, by the downhole conveyance 50 or otherwise). Thus, the piston sub-assembly 206 can operate to repeatedly move the piston assemblies 205 into and out of hammering contact with a 360° radial portion of the production casing 35 to de-bond (or fracture) the cement layer 55 behind the production casing 35.

In some aspects, subsequent to step 604 our during step 604 (for example, between two or more iterations of step 604), the wellbore can be logged (for example, with a logging tool separate from or as part of the downhole tool 200). The log can be a cement bond log that measures bond strength of the cement layer 55. For example, in some aspects, step 604 can be repeated or continue, with one or more cement bond logs taken, until the bond strength of the cement layer 55 has been reduced to a certain desired level by the piston sub-assembly 206.

Figure 7D:
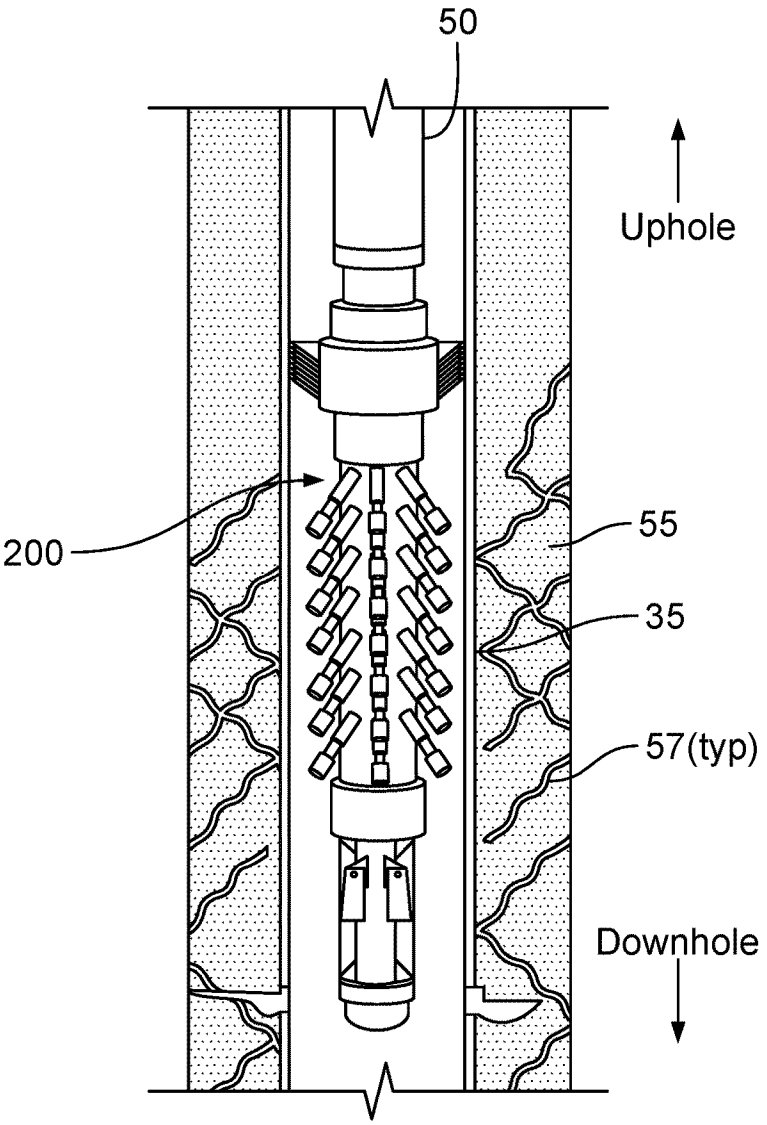
Figure 7C:
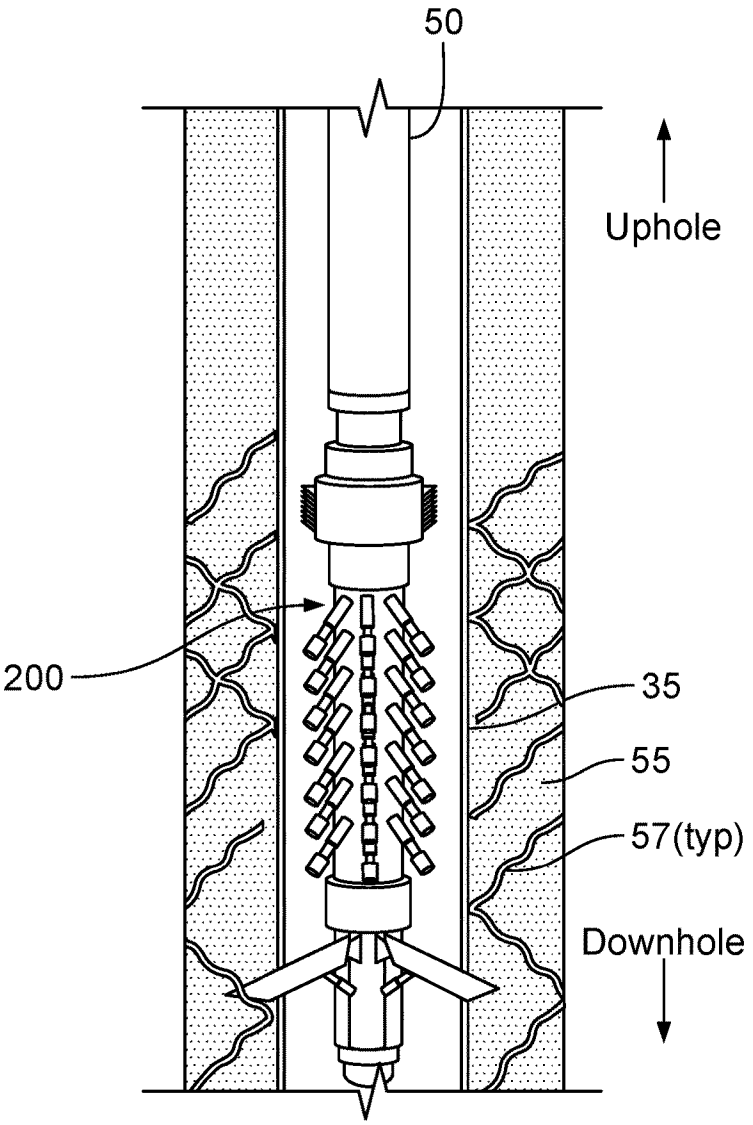

Method 600 can continue at step 606, which includes activating a cutting sub-assembly of the downhole tool to move at least one cutting blade to cut through the portion of the casing adjacent the de-bonded portion of the cement layer. For example, turning to FIG. 7C, once the portion of the production casing 35 (for example, a single location or length of production casing 35) is de-bonded from the cement layer 55, the cutting sub-assembly 208 can be activated (for example, hydraulically or mechanically) to actuate the one or more cutting blades 207 to cut the de-bonded casing (as described with reference to FIGS. 4A-4C). Other components can also be used in place of the described cutting blades 207 to cut the portion of the production casing 35. For example, explosive charges (such as perforation charges), laser cutters, sand or hydrojet cutters, or other cutting mechanisms operable to cut through a wellbore tubular (for example a steel tubular) can be used in place of the cutting blades 207 to cut through the portion of the production casing 35 adjacent the de-bonded portion of the cement layer 55.

In some aspects, the downhole tool 200 can be moved uphole or downhole subsequent to step 604, and step 604 can be repeated at a different location in the wellbore. For example, the downhole conveyance 50 can be operated to move the downhole tool 200 in either direction such that the cutting sub-assembly 208 can be operated to cut through another portion of the casing 35 adjacent the de-bonded portion of the cement layer 55. For example, two (or more) cuts through the production casing 35 can be made in order to remove a specific section of the production casing 35.

Method 600 can continue at step 608, which includes activating a hanger sub-assembly of the downhole tool to move at least one set of slips into contacting engagement with the cut portion of the casing. For example, turning to FIG. 7D, once the portion of the production casing 35 has been cut (once or multiple times), the hanger sub-assembly 204 can be activated (for example, hydraulically or mechanically) to actuate the one or more sets of slips 203 to engage the cut portion of the production casing 35 (as described with reference to FIG. 5). Other components can also be used in place of the described slips 203 to engage the cut portion of the casing 35 to retrieve the cut portion from the wellbore. For example, other profiles, besides the teeth 252 can be used that grab or catch a wellbore tubular. As another example, magnetic or adhesive grips can be used to engage the cut portion of the casing 35 to retrieve it to the surface.

Method 600 can continue at step 610, which includes running the downhole tool on the downhole conveyance out of the wellbore with the cut portion of the casing engaged with the at least one set of slips. For example, once the portion of production casing 35 is engaged with the slips 203, the downhole conveyance 50 may be operated to run the downhole tool 200 out of the wellbore.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a top sub-assembly configured to couple to a downhole conveyance that is operable to run the downhole tool into a wellbore formed from a terranean surface into a subterranean formation;

a piston sub-assembly coupled with the top sub-assembly and comprising a plurality of pistons configured to moveably contact a portion of a casing installed in the wellbore to at least de-bond a portion of a cement layer installed between the portion of the casing and the subterranean formation from the portion of the casing, the piston sub-assembly comprising:

a motor; and a shaft assembly that comprises a shaft coupled to the motor and a plurality of disk assemblies, each disk assembly comprising a disk coupled to the shaft and at least one of the plurality of pistons, where a first pair of adjacent disks are rotatingly coupled together with a coupling attached at a perimeter portion of each of the adjacent disks of the first pair, and a second pair of adjacent disks are rotatingly coupled together with a shaft segment attached at a radial center of each of the adjacent disks of the second pair;

a cutting sub-assembly coupled with the top sub-assembly and the piston sub-assembly and comprising at least one cutting blade configured to moveably cut through the portion of the casing adjacent the de-bonded portion of the cement layer; and a hanger sub-assembly coupled with the top sub-assembly, the piston sub-assembly, and the cutting sub-assembly and comprising at least one set of slips moveable to engage the cut portion of the casing.

2. The downhole tool of claim 1, wherein each disk assembly comprises a pair of pistons of the plurality of pistons are coupled to the coupling, each piston of the pair of pistons coupled to the disk coupling through a jointed arm.

3. The downhole tool of claim 2, wherein the motor is configured to rotate each disk about the shaft to alternatingly extend and withdraw each piston of the pair of pistons into and out of contact with the portion of the casing installed in the wellbore to at least de-bond the portion of the cement layer installed between the portion of the casing and the subterranean formation from the portion of the casing.

4. The downhole tool of claim 2, wherein the first pair of adjacent disks and the second pair of adjacent disks share a common disk.

5. The downhole tool of claim 4, wherein the jointed arm is configured to angularly pivot during rotation of the first pair of adjacent disks.

6. The downhole tool of claim 1, wherein the plurality of pistons are configured to moveably contact the portion of the casing installed in the wellbore to break the portion of the cement layer installed between the portion of the casing and the subterranean formation.

7. The downhole tool of claim 1, wherein the cutting sub-assembly comprises a plurality of cutting blades configured to spin about the downhole tool to cut through the portion of the casing adjacent the de-bonded portion of the cement layer.

8. The downhole tool of claim 1, wherein the at least one set of slips comprises a plurality of sets of slips moveable to engage the cut portion of the casing.

9. The downhole tool of claim 8, wherein each set of the sets of slips comprises a plurality of gripping teeth configured to engage and hold the cut portion of the casing.

10. The downhole tool of claim 8, wherein each set of the sets of slips is configured to expand away from the downhole tool and toward the cut portion of the casing.

11. A method for removing a portion of a tubular from a wellbore, comprising:

running a downhole tool on a downhole conveyance into a wellbore formed from a terranean surface into a subterranean formation;

activating a piston sub-assembly of the downhole tool to repeatedly move a plurality of pistons to contact a portion of a casing installed in the wellbore to at least de-bond a portion of a cement layer installed between the portion of the casing and the subterranean formation from the portion of the casing, wherein activating the piston sub-assembly comprises:

activating a motor to rotate at least one shaft coupled to the motor;

rotating a shaft assembly coupled to the at least one shaft to spin a plurality of disk assemblies, each disk assembly comprising at least one of the plurality of pistons, where spinning the plurality of disk assemblies comprises spinning a first pair of adjacent disks on a coupling attached at a perimeter portion of each of the adjacent disks of the first pair, and spinning a second pair of adjacent disks on a shaft segment attached at a radial center of each of the adjacent disks of the second pair; and oscillating the at least one of the plurality of pistons to contact the portion of the casing installed in the wellbore by spinning the plurality of disk assemblies;

activating a cutting sub-assembly of the downhole tool to move at least one cutting blade to cut through the portion of the casing adjacent the de-bonded portion of the cement layer;

activating a hanger sub-assembly of the downhole tool to move at least one set of slips into contacting engagement with the cut portion of the casing; and running the downhole tool on the downhole conveyance out of the wellbore with the cut portion of the casing engaged with the at least one set of slips.

12. The method of claim 11, wherein each disk assembly comprises a pair of pistons coupled to the coupling at least one disk of the disk assembly through a jointed arm, and oscillating the at least one of the plurality of pistons to contact the portion of the casing installed in the wellbore by spinning the plurality of disk assemblies comprises oscillating the pair of pistons to contact the portion of the casing and another portion of the casing that is angularly offset from the portion of the casing.

13. The method of claim 12, wherein oscillating the pair of pistons to contact the portion of the casing and another portion of the casing that is angularly offset from the portion of the casing comprises:

alternatingly extending and withdrawing each piston of the pair of pistons into and out of contact with the portion of the casing and the another portion of the casing to at least de-bond portions of the cement layer installed between the portion of the casing and the subterranean formation and the another portion of the casing and the subterranean formation.

14. The method of claim 11, further comprising activating the piston sub-assembly of the downhole tool to repeatedly move the plurality of pistons to contact the portion of a casing installed in the wellbore to break the portion of the cement layer installed between the portion of the casing and the subterranean formation.

15. The method of claim 11, wherein activating the cutting sub-assembly of the downhole tool to move at least one cutting blade comprises rotating a plurality of cutting blades about the downhole tool to cut through the portion of the casing adjacent the de-bonded portion of the cement layer.

16. The method of claim 11, wherein activating the hanger sub-assembly of the downhole tool to move at least one set of slips into contacting engagement with the cut portion of the casing comprises:

extending an arm of the at least one set of slips toward the cut portion of the casing; and gripping the cut portion of the casing with a plurality of teeth of the at least one set of slips that are attached to the arm.

17. The method of claim 11, further comprising, while activating the piston sub-assembly of the downhole tool to repeatedly move the plurality of pistons to contact the portion of a casing installed in the wellbore:

moving the downhole tool uphole or downhole in the wellbore to another position adjacent another portion of the casing installed in the wellbore; and repeatedly moving the plurality of pistons to contact the another portion of the casing installed in the wellbore to at least de-bond the another portion of the cement layer installed between the another portion of the casing and the subterranean formation from the another portion of the casing.

18. The method of claim 17, further comprising, subsequent to activating the cutting sub-assembly of the downhole tool to move the at least one cutting blade to cut through the portion of the casing adjacent the de-bonded portion of the cement layer:

deactivating the cutting sub-assembly of the downhole tool to stop movement of the at least one cutting blade;

moving the downhole tool uphole or downhole in the wellbore adjacent the another portion of the casing; and re-activating the cutting sub-assembly of the downhole tool to move the at least one cutting blade to cut through the another portion of the casing adjacent the de-bonded another portion of the cement layer.

19. The method of claim 18, further comprising activating the hanger sub-assembly of the downhole tool to move the at least one set of slips into contacting engagement with the cut portion of the casing between the portion of the casing and the another portion of the casing.

20. A downhole tool system, comprising:

a connector configured to couple to a means for conveying the downhole tool system into and out of a wellbore;

means for repeatedly contacting a portion of a casing installed in the wellbore to at least de-bond a portion of a cement layer installed between the portion of the casing and a rock formation, the means for repeatedly contacting the portion of the casing installed in the wellbore comprising:

means for rotating a first pair of first adjacent disks together to alternatingly extend at least two pistons into contact with the portion of the casing from the first pair of first adjacent disks, the means for rotating the first pair of first adjacent disks comprising a coupling attached at a perimeter portion of each of the first adjacent disks of the first pair, and means for rotating a second pair of second adjacent disks together to transfer rotational motion to a second pair of first adjacent disks, the means for rotating the second pair of second adjacent disks comprising a shaft segment attached at a radial center of each of the second adjacent disks of the second pair;

means for cutting through the portion of the casing adjacent the de-bonded portion of the cement layer; and means for engaging the cut portion of the casing to retrieve the cut portion of the casing from the wellbore.

21. The downhole tool system of claim 20, wherein the means for repeatedly contacting the portion of the casing is configured to be hydraulically activated or mechanically activated.

22. The downhole tool system of claim 20, wherein the means for cutting through the portion of the casing comprises one or more extendable cutting blades.

23. The downhole tool system of claim 20, further comprising a bore that extends through the means for repeatedly contacting the portion of the casing, the means for cutting through the portion of the casing, and the means for engaging the cut portion of the casing.

24. The downhole tool system of claim 23, wherein the bore comprises a fluid pathway for a hydraulic fluid configured to activate at least one of the contacting the portion of the casing, the means for cutting through the portion of the casing, or the means for engaging the cut portion of the casing.

25. The downhole tool system of claim 20, wherein the means for repeatedly contacting the portion of the casing installed in the wellbore is configured to fracture the portion of the cement layer installed between the portion of the casing and the rock formation.

* * * * *